US010895057B2

(12) United States Patent
Hill

(10) Patent No.: US 10,895,057 B2
(45) Date of Patent: Jan. 19, 2021

(54) COUPLER WITH CONTACTLESS ATTACHMENT ENGAGEMENT DETECTION

(71) Applicant: Hiltec Designs Ltd, Newry (GB)

(72) Inventor: Ian Hill, Newry (GB)

(73) Assignee: Hiltec Designs Ltd., Newry (GB)

( * ) Notice: Subject to any disclaimer, the term of this patent is extended or adjusted under 35 U.S.C. 154(b) by 552 days.

(21) Appl. No.: 15/602,767

(22) Filed: May 23, 2017

(65) Prior Publication Data

US 2017/0335540 A1 Nov. 23, 2017

(30) Foreign Application Priority Data

May 23, 2016 (GB) ..... 1609034.2

(51) Int. Cl.
*E02F 3/36* (2006.01)
*E02F 9/26* (2006.01)

(52) U.S. Cl.
CPC ..... *E02F 3/3618* (2013.01); *E02F 3/3622* (2013.01); *E02F 3/3663* (2013.01); *E02F 9/265* (2013.01); *Y10T 403/593* (2015.01)

(58) Field of Classification Search
CPC ..... E02F 3/3604; E02F 3/3609; E02F 3/3613; E02F 3/3618; E02F 3/3622; E02F 3/3627; E02F 3/3663; E02F 9/264; E02F 9/265; F16B 2/10; Y10T 403/59; Y10T 403/591; Y10T 403/593
USPC ..... 403/321, 322.1, 322.3
See application file for complete search history.

(56) References Cited

U.S. PATENT DOCUMENTS 6,301,811 B1 * 10/2001 Gilmore, Jr. ..... E02F 3/3622 37/468
6,699,001 B2 * 3/2004 Fatemi ..... E02F 3/3618 37/468
8,262,310 B2 * 9/2012 Sikorski ..... E02F 3/3618 403/322.3

(Continued)

FOREIGN PATENT DOCUMENTS

DE 10111529 A1 9/2002
DE 202014004430 U1 9/2014

(Continued)

OTHER PUBLICATIONS

"Choosing an Ultrasonic Sensor . . . " Massa, Donald P. Fierce Electronics. [online], [retrieved on Feb. 24, 2020]. Retrieved from the Internet <URL: https://www.fierceelectronics.com/components/choosing-ultrasonic-sensor-for-proximity-or-distance-measurement-part-1-acoustic>.*

(Continued)

*Primary Examiner* — Josh Skroupa
(74) *Attorney, Agent, or Firm* — Christopher & Weisberg, P.A.

(57) ABSTRACT

A coupler for coupling an attachment to an excavator. The coupler has first and second spaced-apart coupling formations for coupling with respective corresponding coupling formation of the attachment. The coupler also has a power actuated locking member for retaining the respective attachment coupling formation in engagement with the first coupling formation. A detection system is capable of detecting if the respective attachment coupling formation is in a desired position with respect to the first coupling formation, wherein the detecting means comprises at least one non-contact sensor, preferably an ultrasonic sensor.

12 Claims, 6 Drawing Sheets

(56) References Cited

U.S. PATENT DOCUMENTS

| | | | | |
|---|---|---|---|---|
| 8,585,345 | B2 * | 11/2013 | Sikorski | E02F 3/3618 414/723 |
| 9,562,346 | B2 * | 2/2017 | Jonsson | E02F 3/3663 |
| 9,834,904 | B2 * | 12/2017 | Friedrich | E02F 3/3618 |
| 2005/0193603 | A1 | 9/2005 | Schultz et al. | |
| 2009/0223096 | A1 * | 9/2009 | Wimmer | E02F 3/3663 37/468 |
| 2011/0313625 | A1 | 12/2011 | Miller et al. | |
| 2015/0240456 | A1 | 8/2015 | Jonsson et al. | |
| 2016/0237656 | A1 * | 8/2016 | Doherty | E02F 3/3663 |
| 2018/0066418 | A1 * | 3/2018 | Keighley | E02F 3/3663 |

FOREIGN PATENT DOCUMENTS

| | | | |
|---|---|---|---|
| EP | 0823343 | A1 | 2/1998 |
| EP | 2803768 | A2 | 11/2014 |
| EP | 2803768 | A3 | 4/2015 |
| KR | 101478498 | B1 | 1/2015 |
| WO | 2008138932 | A2 | 11/2008 |
| WO | 2008138932 | A3 | 11/2008 |
| WO | 2015060730 | A1 | 4/2015 |

OTHER PUBLICATIONS

European Search Report and Written Opinion for corresponding European Application No. EP 17 17 2375, dated Mar. 15, 2018, consisting of 12-pages.

* cited by examiner

COUPLER WITH CONTACTLESS ATTACHMENT ENGAGEMENT DETECTION

FIELD OF THE INVENTION

The present invention relates to couplers for coupling an attachment, such as an excavating bucket, to the arm of an excavator or other machine. The invention relates particularly to quick couplers that are powered, especially hydraulically powered, and includes couplers that are capable of accommodating attachments with different pin spacings.

BACKGROUND TO THE INVENTION

Hydraulic couplers for quickly connecting and disconnecting construction attachments from excavating equipment are well known and are sometimes referred to as semi-automatic or automatic couplers since they can be operated by an operator from within the cab of an excavator or other machine. International PCT patent application WO2011/035883 discloses an example of such a coupler.

When operating an automatic or semi-automatic coupler the front pin of the attachment is normally visible to the operator who can therefore visually check that the attachment pin is correctly engaged by the coupler. However, the rear attachment pin is usually not visible to the operator. This can create a problem in that the rear pin may not be located correctly when the coupler's locking mechanism is operated. This can result in the rear pin not being engaged correctly, allowing the attachment to be free to swing on the front pin or to fully separate from the coupler when the coupler orientation is changed.

One option for detecting the pin position is to provide a movable lever that is forced into an indicating position by the rear pin when correctly positioned. However the use of levers within the coupler can be problematic due to both the environment and the forces imparted to the lever under normal service conditions. It would be desirable therefore to provide an alternative solution for determining that the rear pin is in the correct position before closing the coupler's locking mechanism. It would also be desirable for the solution to be application to alternative types of coupler.

SUMMARY OF THE INVENTION

Accordingly, a first aspect of the invention provides a coupler for coupling an attachment to an excavator or other apparatus, the coupler comprising a body having a first and second spaced-apart coupling formations for coupling with a respective corresponding coupling formation of said attachment; a locking member movable into and out of a locking state in which it is capable of retaining the respective attachment coupling formation in engagement with said first coupling formation; actuating means for actuating said locking member into and out of said locking state; and a detection system comprising means for detecting if said respective attachment coupling formation is in a desired position with respect to said first coupling formation, and typically means for indicating to an operator that said respective attachment coupling formation is detected in said desired position, wherein said detecting means comprises at least one non-contact sensor configured to generate a detection zone and to generate an output signal that is indicative of whether or not said respective attachment coupling formation is detected in said detection zone.

In some embodiments, the, or each, sensor may be of a type that generates a detection zone by generating an electromagnetic sensing field, or a magnetic sensing field, or an optical sensing field. For example, the detection system may comprise one or more electric field sensor, one or more radio frequency (RF) sensor, one or more magnetic sensor, and/or one or more optical, e.g. infra-red or laser, sensor.

In preferred embodiments, the, or each, sensor is an acoustic sensor, preferably an ultrasonic sensor, that generates the detection zone using acoustic, preferably ultrasonic waves, i.e. a sensor that detects target objects using acoustic, preferably ultrasonic, waves. Preferably the or each sensor is a directional acoustic sensor, most preferably a directional ultrasonic sensor.

In typical embodiments there is only one sensor, although more than one could be provided. Optionally, any combination of two or more sensor types may be provided, i.e. one or more sensor of each of any two or more sensor types.

The or each sensor may comprise a single sensor component that generates the detection zone and detects the presence of an object in the detection zone (which may be referred to as a transceiver sensor component), or may comprise two or more sensor components, for example spaced apart sensor components between which the detection zone is defined in use. In such cases, there may be provided one or more transmitter component (which generates the sensing field/waves as applicable that create the detection zone) spaced apart from and aligned with one or more receiver component (which detects the presence of a target object in the detection zone). Alternatively, there may be provided one or more reflector component spaced apart from and aligned with one or more transceiver sensor component, or spaced apart from and aligned with one or more transmitter component and one or more receiver component.

In preferred embodiments, said at least one sensor is configured such that the detection zone is positioned adjacent (but on the outside of) a surface of the first coupling formation that engages in use with the respective attachment formation when the respective formations are correctly engaged in use so that, when there is correct engagement, the attachment coupling formation is detected in the detection zone. Advantageously, this allows correct engagement of the first coupling formation and the respective attachment formation before the locking member is actuated into its locking state and while the locking member is in the locking state.

In some embodiments, the detection zone is configured (i.e. shaped, dimensioned and/or directed, as applicable) to extend across a surface of said first coupling formation that engages in use with the corresponding attachment coupling, for example across a pin-receiving surface of a pin-receiving recess. In other embodiments, the detection zone is configured (i.e. shaped, dimensioned and/or directed, as applicable) to extend away from a surface of said first coupling formation that engages in use with the corresponding attachment coupling, for example away from the free end of a coupling projection.

Configuring the detection zone typically involves configuring any one or more of its shape, dimensions and or direction. Configuring the detection zone dimensions may involve setting any one or more of its length, height and/or width.

Typically, the direction of the detection zone is determined by the orientation of the at least one sensor, particularly since the detection zone usually has a longitudinal axis that extends from the sensor. The shape of the sensing field may be determined by the type of sensor(s) used and/or by setting the region's dimension(s).

In preferred embodiments, said at least one sensor is of a type that generates a detection zone having a longitudinal axis that extends from the sensor, for example a directional sensor. Preferably the sensor is of a type that generates a detection zone that is beam shaped and typically elongate. The preferred detection zone may be described as a directional detection zone (in contrast to an omnidirectional detection zone).

Preferably, said at least one sensor is configurable (or programmable) to adjust one or more characteristics of the detection zone, e.g. any one or more of the length, width or height of the detection zone.

In preferred embodiments, the or each sensor is a directional ultrasonic sensor that is programmable to adjust the length of the detection zone.

The preferred detection system comprises at least one sensor, preferably electronic, said detection means being configured to directly detect the correct positioning of the rear attachment coupling formation in a position wherein the locking member is ensured to engage with and retain the rear attachment coupling formation correctly.

In preferred embodiments, the or each sensor is provided on the body of the coupler at a location where it is protected from impacts, e.g. with the attachment coupling formation and/or the locking member and/or the external environment. For example, the body may comprise first and second spaced apart body portions, e.g. plates, the or each sensor being provided between the body portions. Also, while the or each sensor is typically located adjacent the first coupling formation, advantageously it is positioned so that it does not project beyond the coupler body, e.g. is fully located between the spaced body portions.

The signal from the sensor may also be integrated into the coupler control circuit preventing the coupler closing until the rear engagement is correct or even integrated into the machines controls reducing machine power until the rear engagement is correct.

Optionally, the detection system may be integrated with a controller of the coupler, the controller being responsive to said output signal, or a derivative thereof, to prevent the locking member from adopting said locked state unless said output signal, or derivative, indicates that the respective attachment coupling formation is detected in said detection zone.

Optionally, the detection system may be integrated with a controller of said excavator or other apparatus, the controller being responsive to said output signal, or a derivative thereof, to prevent or restrict operation of said excavator or other apparatus unless said output signal, or derivative, indicates that the respective attachment coupling formation is detected in said detection zone. For example the controller may be configured to fully or partly disable one or more power supply of the excavator or apparatus, e.g. disabling the engine and/or hydraulic system.

A second aspect of the invention provides a detection system for a coupler, the detection system comprising means for detecting if a respective attachment coupling formation is in a desired position with respect to a first coupling formation of the coupler, and means for indicating to an operator that said respective attachment coupling formation is detected in said desired position, wherein said detecting means comprises at least one non-contact sensor configured to generate a detection zone and to generate an output signal that is indicative of whether or not said respective attachment coupling formation is detected in said detection zone.

Preferred embodiments enable an operator to detect that the rear attachment coupling formation is in the correct engaged position before operating the locking mechanism to prevent the risk of the lock failing to ensure that the formation is retained in the desired working position when the locking mechanism is locked.

Further advantageous aspects of the invention will be apparent to a skilled person upon review of the following description of a preferred embodiment and with reference to the accompanying drawings.

BRIEF DESCRIPTION OF THE DRAWINGS

Embodiments of the invention are now described by way of example and with reference to the accompanying drawings in which like numerals are used to denote like parts and in which.

DETAILED DESCRIPTION OF THE DRAWINGS

Figure 1:
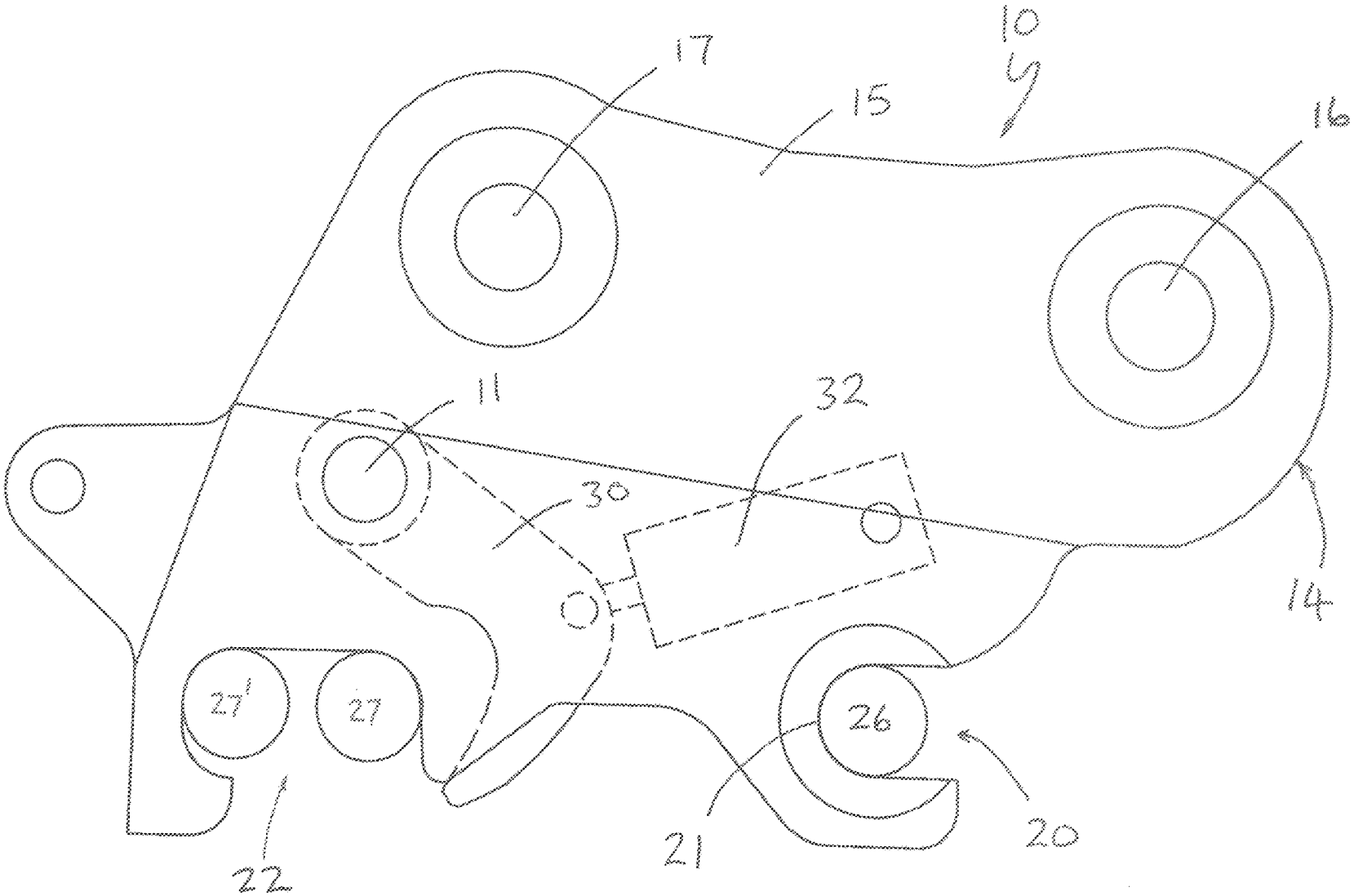
FIG. 1 is a side view of a first type of coupler known as a "pin grabber" type coupler.
Figure 2:
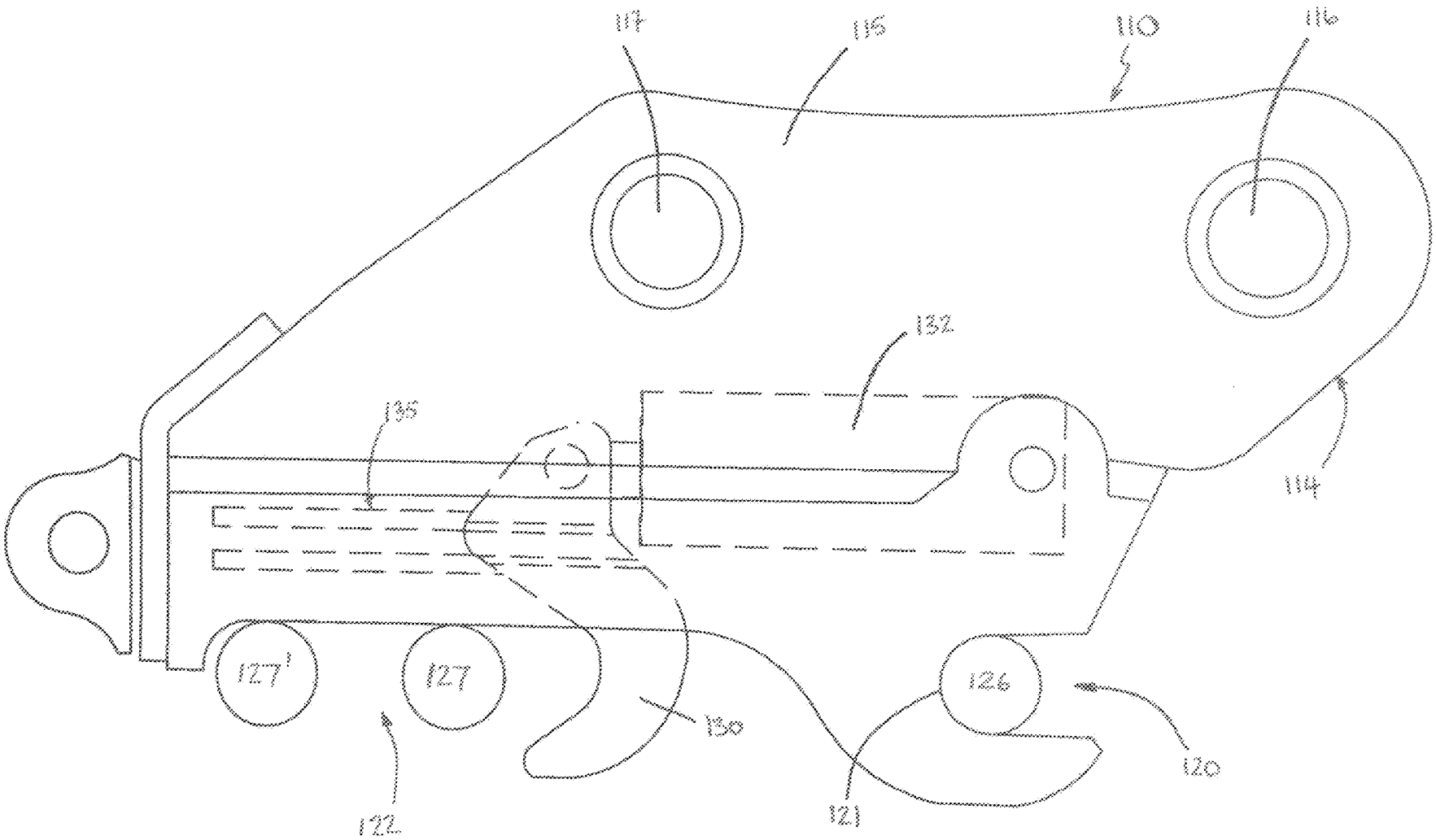
FIG. 2 is a side view of a second type of coupler known as a "wedge" type coupler.
Figure 3:
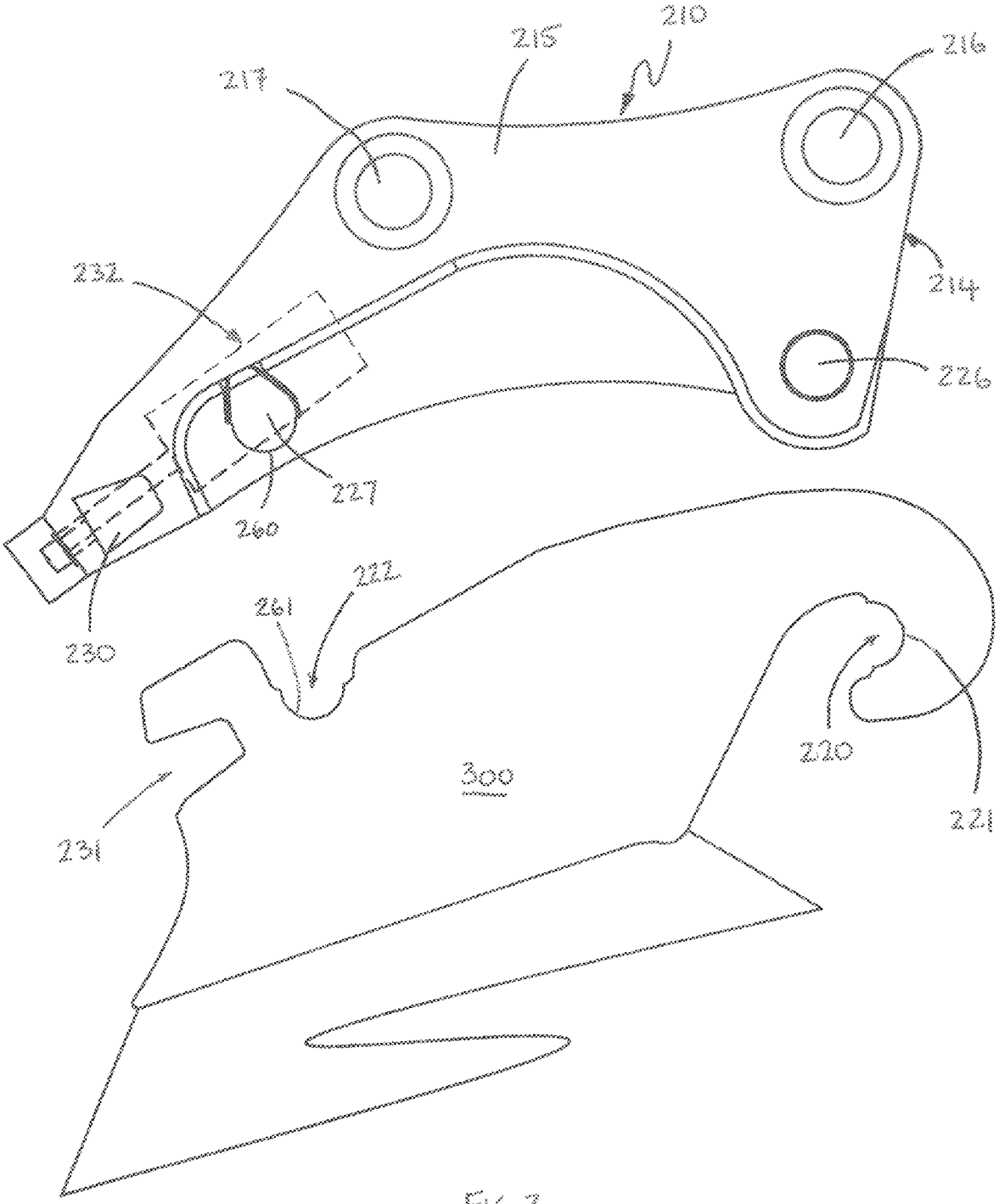
FIG. 3 is a side view of a third type of coupler known as a "dedicated" type coupler, part of an attachment also being shown.

Referring now to FIGS. 1 to 3 of the drawings there is shown, generally indicated as 10, 110 and 210, a respective coupler (or hitch) for connecting a tool, or other attachment such as a bucket or hammer, to an arm of an excavator (not shown), or other apparatus. Couplers embodying the invention are typically of a type known as quick couplers, more particularly automatic couplers or semi-automatic couplers. The coupler 10 of FIG. 1 is of a type known as a pin grabber. The coupler 110 of FIG. 2 is of a type known as a wedge coupler. The coupler 210 of FIG. 3 is of a type known as a dedicated coupler.

The coupler 10, 110, 210 has a body 14, 114, 314 typically comprising two spaced-apart body parts typically in the form of side plates 15, 115, 215 (only one shown). The body 14, 114, 214 is shaped to define pin-receiving apertures 16, 116, 216, and 17, 117, 217 by which the coupler may be connected to the end of the arm. Typically, there are two spaced-apart apertures 16, 116, 216, and 17, 117, 217 in each of the two side plates, the apertures in one side plate being aligned with the apertures in the other. When connected, the coupler 10, 110, 210 is able to pivot with respect to the arm about the axis of the one of the apertures 16, 116, 216. Usually a hydraulic mechanism, or other power operated mechanism (not shown), is provided, typically in association with a mechanical linkage, to pivot the coupler 10, 110, 210 with respect to the arm. The mechanical linkage is usually connected between the arm and the other aperture 17, 117, 217.

Referring now in particular to the coupler 10 of FIG. 1, the body 14 includes first and second spaced apart coupling formations in the form of first and second pin-receiving recesses 20, 22 formed in each side plate 15. Each recess 20, 22 is shaped and dimensioned to receive a respective attachment coupling formation, in this case a respective pin 26, 27, 27', of a bucket or other attachment. Normally, the recesses 20, 22 face in mutually perpendicular directions. The recess 20 is typically hook-like in shape and function. The recess 22 may be wider than is necessary to receive a single pin 26 in order to accommodate attachments with different pin spacings, as is illustrated by pins 27 and 27' which are intended to represent a respective pin of a respective attachment, the attachment of pin 27 having narrower pin spacings than the attachment of pin 27'. Clearly, the pins 27, 27' would not normally be present in the recess 22 simultaneously. The coupler 10 can accommodate attachments having a range of pin spacings between a smallest spacing shown between pins 26 and 27 and a largest spacing shown between pins 26 and 27'. Such couplers are commonly referred to as universal couplers.

The coupler 10 also includes a power-operated locking mechanism typically comprising a locking member, in the preferred form of a hook 30, coupled to an actuator 32 typically in the form of a linear actuator such as a hydraulic ram. Other forms of powered actuator could be used (e.g. pneumatic or electrically operated) but hydraulic is convenient because excavators typically have a hydraulic system available at or near the end of the arm. The locking hook 30 and ram 32 are provided between the side plates 15. The locking hook 30, which may comprise one or more aligned hook elements, is pivotably mounted on the body 14 at pivot 11 in any convenient manner and is pivotable about an axis that runs substantially perpendicular to the body 14/plates 15. The hook 30 is pivotable between an open, or non-locking, state (as shown in FIG. 1) and a locking state (not illustrated) by the actuator 32. In the open state, the locking hook 30 allows the pins 27, 27' to be inserted into or removed from the recess 22. In the locking state, the locking hook 30 prevents the pins 27, 27' from being removed from the recess 22. The actual position of the locking member 30 in the locking state will depend on the pin spacing of the attachment being grabbed.

Conventionally, the recess 22 is said to be at the rear of the coupler and the locking member 30 may therefore be referred to as a rear locking member.

Under normal operating conditions when the locking hook 30 is in its locking state, the pin 26 located in recess 20 is urged against the rear surface 21 of the recess 20 by the action of the locking hook 30 on the other pin 27, 27' located in the other recess 22 under the force exerted by the actuator 32.

Referring now in particular to FIG. 2, the body 114 of coupler 110 includes first and second spaced apart coupling formations in the form of pin-receiving recesses 120, 122 formed in each side plate 115. Each recess 120, 122 is shaped and dimensioned to receive a respective attachment coupling formation, in this case a respective pin 126, 127, 127', of a bucket or other attachment. In certain universal type couplers the recess 122 may be wider than is necessary to receive a single pin 126 in order to accommodate attachments with different pin spacings, as is illustrated by pins 127 and 127' which are intended to represent a respective pin of a respective attachment, the attachment of pin 127 having narrower pin spacings than the attachment of pin 127'. The pins 127, 127' would not normally be present in the recess 122 simultaneously. The universal type coupler can therefore accommodate attachments having a range of pin spacings between a smallest spacing shown between pins 126 and 127 and a largest spacing shown between pins 126 and 127'.

The coupler 110 also includes a power-operated locking mechanism typically comprising a locking member 130, which in the illustrated example is hook shaped, coupled to an actuator 132 typically in the form of a linear actuator such as a hydraulic ram. Other forms of powered actuator could be used (e.g. pneumatic or electrically operated) but hydraulic is convenient because excavators typically have a hydraulic system available at or near the end of the arm. The locking member 130 and ram 132 are provided between the side plates 115. The locking member 130 is moveable between an open, or non-locking, state (as illustrated) and a locking state by the actuator 132. In the open state, the locking mechanism allows the pins 127, 127' to be inserted into or removed from the recess 122. In the locking state, the locking hook 130 prevents the pins 127, 127' from being removed from the recess 122. The actual position of the locking member 130 in the locking state will depend on the pin spacing of the attachment being grabbed. The locking member 130 is movable substantially linearly between the open and locking states by the actuator 132, and to facilitate this may be slidably mounted on the body 114, for example by means of a linear slide mechanism 135 coupling the locking member 130 to the body 114. Conventionally, the recess 122 is said to be at the rear of the coupler and the locking member 130 may therefore be referred to as a rear locking member.

Under normal operating conditions when the locking hook 130 is in its locking state, the pin 126 located in recess 120 is urged against the rear surface 121 of the recess 120 by the action of the locking hook 130 on the other pin 127, 127' located in the other recess 122 under the force exerted by the actuator 132.

Referring now in particular to FIG. 3, the body 214 of coupler 210 includes first and second spaced apart coupling formations in the form of protrusions 226, 227, e.g. pins or other protruding formations, provided on each side plate 215. Each protrusion 226, 227 is shaped and dimensioned to be received in a respective attachment coupling formation, in this case a respective recess 220, 222, of a dedicated attachment head 300 (being part of, or connectable to, the respective attachment).

The coupler 210 also includes a power-operated locking mechanism typically comprising a locking member 230, which in this example is wedge shaped, coupled to an actuator 232 typically in the form of a linear actuator such as a hydraulic ram. Other forms of powered actuator could be used (e.g. pneumatic or electrically operated) but hydraulic is convenient because excavators typically have a hydraulic system available at or near the end of the arm. The locking member 230 is moveable by the actuator 232 between an open, or non-locking, state (as illustrated) and a locking state. In the open state, the locking member 230 allows the pin type protrusion 227 to be inserted into or removed from the recess 222. In the locking state, the locking mechanism 230 engages in a formation 231 provided on the head 300. This engagement, in combination with the engagement of pin 226 in recess 220, prevents the pin type protrusion 227 from being removed from the recess 222. The locking member 230 is movable substantially linearly between the open and locking states by the actuator 232, and to facilitate this may be is slidably mounted on the body 214, for example by means of a linear slide mechanism (not shown) coupling the locking member 230 to the body 214. The formation 231 typically takes the form of a recess shaped and dimensioned to receive the locking member 230. The locking member 230 need not necessarily take the form of a wedge, e.g. it may comprise any other male member that corresponds with the female formation provided in the head 300. Conventionally, the recess 222 is said to be at the rear of the coupler and the locking member 230 may therefore be referred to as a rear locking member.

Under normal operating conditions when the locking member 230 is in its locking state, the pin 226 located in recess 220 is urged against the front surface 221 of the recess 220 by the action of the locking member 230 on the mating formation 231 of the dedicated attachment head 300 and the restraining action of protrusion 227 within recess 222 under the force exerted by the actuator 232 urging the locking member 230 toward the front of the coupler.

The couplers 10, 110, 210 may be referred to as an automatic coupler, or a power operated coupler, and are exemplary of the general types of coupler with which embodiments of the invention may be implemented but it will be understood that the invention is not limited to use with the specific couplers shown in FIG. 1, 2 or 3.

Figure 4:
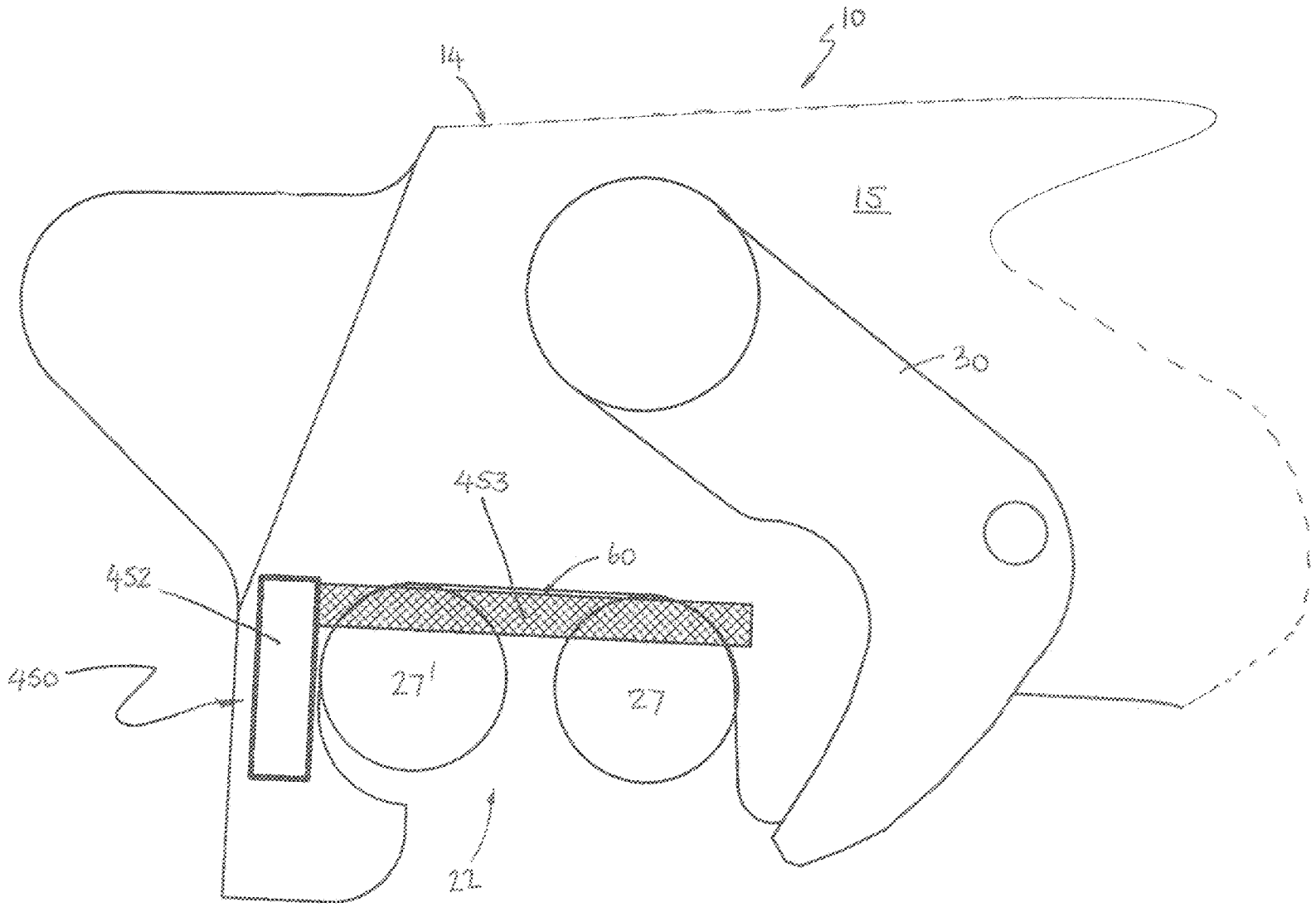
FIG. 4 is an interior side view of part of a first coupler embodying one aspect of the invention, the coupler being of the type shown in FIG. 1 and including a detection system embodying another aspect of the invention.

Referring now to FIG. 4, there is shown a pin detection system 450 embodying one aspect of the invention included in the coupler 10. FIG. 4 shows a side view of part of the coupler body 14, in particular the part that is normally referred to as the rear of the coupler 10. The illustrated body part includes the (rear) recess 22, which is shaped and dimensioned to receive the attachment pin 27 in more than one location within the recess 22, as illustrated by the pin 27'.

The detection system 450 comprises detection means in the form of a non-contact sensor 452 configured to generate a detection zone 453 and to generate an output signal that is indicative of whether or not the pin 27, 27' (as applicable) is detected in the detection zone 453. Preferably, the sensor 452 is an acoustic sensor, in particular an ultrasonic sensor, that generates the detection zone 453 using acoustic, preferably ultrasonic waves, i.e. the sensor 452 detects the pin using acoustic, preferably ultrasonic, waves. Advantageously, the sensor 452 is a directional acoustic sensor, preferably a directional ultrasonic sensor. It is found that ultrasonic sensors are particularly reliable for use in tough environments such as those experienced when provided on an excavator coupler. By way of example, ultrasonic sensors made by Microsonic GmbH of Dortmund Germany, e.g. the model no. sks-15D ultrasonic sensor, or from the BUS (trade mark) range of ultrasonic sensors provided by Balluff GmbH of Neuhausen Germany are suitable for use in embodiments of the present invention.

When the pin 27, 27' is correctly positioned in the recess 22 it engages with a pin-receiving surface 60 that defines part of the recess 22, which is usually a surface of the body 14, and is usually the bottom surface of the recess 22, i.e. the surface that runs between the sides of the recess 22.

The sensor 452 is configured such that the detection zone 453 is positioned adjacent the pin-receiving surface 60 of the recess 22 (but on the outside of, i.e. located in the recess 22 adjacent the surface 60), preferably extending along substantially the entire length of the pin-receiving surface 60. The detection zone need not be touching the surface 60 (as illustrated in FIG. 4) so long as it is positioned such that the pin 27, 27', i.e. at least part of the pin, is in the detection zone 453 when the pin is correctly engaged in the recess 22.

In preferred embodiments, the sensor 452 is a directional sensor and the detection zone 453 has a longitudinal axis that extends away from the sensor 452. Advantageously, the sensor 452 is of a type that generates a beam shaped elongate detection zone.

The preferred sensor 452 is configurable (or programmable) to adjust one or more characteristics of the detection zone 453, in particular the length of the detection zone 453. In any event, the detection zone 453 is advantageously configured such that its length substantially matches that of the surface 60, i.e. so that the detection zone 453 extends along substantially the whole length of the surface 60 but does not extend beyond (i.e. not significantly beyond) the surface 60. This reduces the chance that a false pin detection is made as a result of another object being present in the detection zone 453. For similar reasons, it is preferred that the height of the detection zone 453 (vertical dimension as viewed in FIG. 4) does not exceed the depth of the recess 22 (vertical dimension as viewed in FIG. 4), and more preferably is less than half of the depth of the recess 22. It is also preferred that the width of the detection zone 453 does not exceed the width of the recess 22, which in typical embodiments corresponds to the width of the plate 15 in which the recess is formed. Depending on the type of sensor used, the height and/or width of the detection zone 453 may be inherently suitable for the present application, or may need to be set by configuring the sensor 452.

Typically, the direction of the detection zone 453 is determined by the orientation of the sensor 452, particularly where the detection zone has a longitudinal axis extending from the sensor 452.

More generally, configuring the detection zone may involve configuring any one or more of its shape, dimension (s) and or direction. Configuring the detection zone dimensions may involve setting any one or more of its length, height and/or width by configuring the sensor accordingly.

In preferred embodiments, the sensor 452 is mounted directly or indirectly on the body 14 adjacent the recess 22 and orientated such that the detection zone extends across the recess 22 as described. Advantageously, the sensor 452 is provided at a location where it is protected from impacts, e.g. positioned between the plates 15 so that it is not exposed by the recess 22.

In use, when the pin 27, 27' is correctly positioned in the recess 22 to allow it to be engaged correctly by the locking member 30, the pin 27, 27' engages with the surface 60 and is in the detection zone 453. The pin 27, 27' and is therefore detected by sensor 452 which produces an output signal indicating that the pin 27, 27 is detected in the zone 453. The sensor output therefore serves as a signal to indicate the correct engagement of the attachment and coupler 10 prior to the operation of the locking member 30.

When the pin 27, 27' enters the recess 22, it must enter the detection zone 453 before it can engage the surface 60 of the recess 22. When the pin 27, 27' engages with the surface 22 its movement is halted and the pin 27, 27' remains within the detection zone 453. Accordingly, when the pin 27, 27' is correctly located in the recess 22 for the purposes of locking by the locking member 30 (i.e. prior to being engaged by the locking member 30 and advantageously prior to operation of the locking member to the locking state), the sensor 452 has detected the pin and has produced an output indicating this. Advantageously, while the locking member 30 is in the locking state, the sensor 452 continues to detect the pin 27, 27' while it remains engaged with the surface 60, and its output signal may be indicative of this.

In preferred embodiments, the sensor 452 has a single continuous detection zone 453 which detects the pin 27, 27' at or close to a position where pin 27, 27' contacts surface 60, irrespective of the pin spacing of the attachment. The detection zone 453 typically extends along substantially the entire length of the bottom surface of the recess 22. In any case, the preferred pin detection system 450 is capable of detecting the correct location of the pin in multiple locations in the recess 22 to accommodate attachments with different pin spacings without any direct mechanical contact between the sensor 452 and the pin and prior to the operation of the locking member 30.

Figure 5:
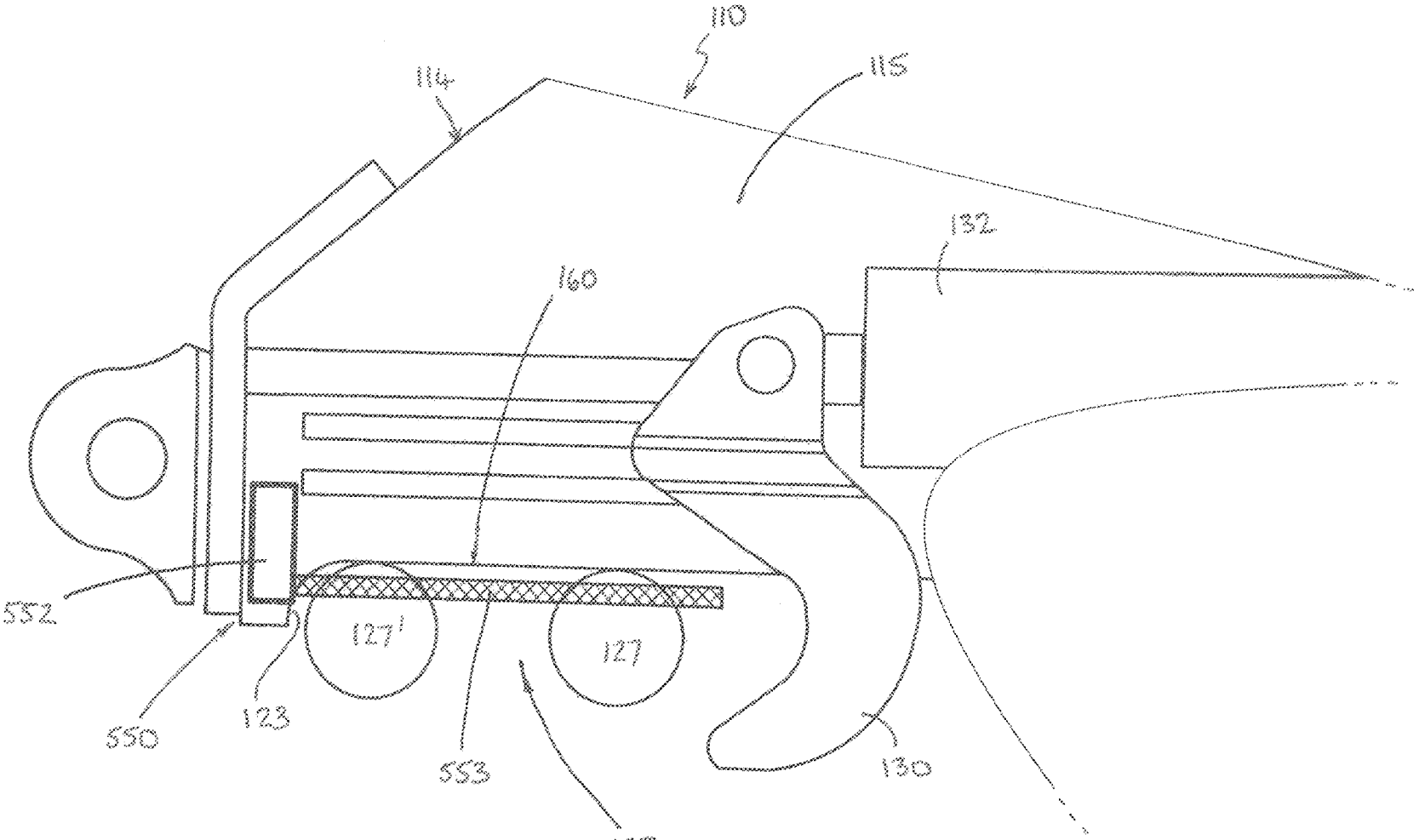
FIG. 5 is an interior side view of part of a second coupler embodying one aspect of the invention, the coupler being of the type shown in FIG. 2 and including a detection system embodying another aspect of the invention.

Referring now to FIG. 5, there is shown a pin detection system 550 embodying one aspect of the invention included in the coupler 110. FIG. 5 shows a side view of part of the coupler body 114, in particular the part that is normally referred to as the rear of the coupler 110. The illustrated body part includes the (rear) recess 122, which is shaped and dimensioned to receive an attachment pin 127, 127' in more than one location within the recess 122. This allows attachments with different pin spacings illustrated as 127, 127' to be engaged by the coupler 110.

The pin detection system 550 comprises a sensor 552 with detection zone 553. The system 550 may be the same or similar to the detection system 450 and so the same or similar description applies, as would be apparent to a skilled person, unless otherwise indicated. Accordingly, when the pin 127, 127' is correctly positioned in the recess 122 to allow it to be engaged correctly by the locking member 130, the pin 127, 127' (i.e. at least part of it) is in the detection area 553 and is detected by sensor 552, the detection being indicated by the output of the sensor 552, which can therefore be used as an indication of the correct engagement of the attachment and coupler prior to the operation of the locking member 130.

When the pin 127, 127' is correctly positioned in the recess 122 it engages with pin-receiving surface 160 that defines part of the recess 122, and which is usually a surface of the body 114. The surface 160 is usually the bottom surface of the recess 122. In this embodiment, the pin-receiving part of the recess 122 has a rear lip 123 but no front lip. Therefore the detection zone 553 does not extend along the entire length of the recess 122 but does extend along the entire length of the pin-receiving part of the recess 122.

In other embodiments (not illustrated) the pin-receiving surface need not be provided in a recess.

When the pin 127, 127' enters the recess 122 it must enter the detection area 553 before it can engage the surface 160. When the pin 127, 127' engages with the surface 160 its movement is halted and the pin 127, 127' remains within the detection zone 553. Accordingly, when the pin 127, 127' is correctly located in the recess 122 for the purposes of locking by the locking member 130 (i.e. prior to being engaged by the locking member and advantageously prior to operation of the locking member to the locking state), the sensor 552 detects the pin. Advantageously, while the locking member 130 is in the locking state, the sensor 552 continues to detect the pin 127, 127' while it remains engaged with the surface 160, and its output signal may be indicative of this.

Preferably, the sensor 552 has a single continuous detection zone 553 which detects the pin 127, 127' at, or close to a position where pin contacts surface 160, irrespective of the pin spacing of the attachment. In the embodiment of FIG. 5, the detection zone is adjacent but spaced from the surface 160. The preferred pin detection system 550 is capable of detecting the correct location of the pin in multiple locations in the recess 122 to accommodate attachments with different pin spacings without any direct mechanical contact between the sensor and the pin and prior to the operation of the locking member.

Alternatively, or in addition, the detection means may comprise one or more other detectors, for example optical and/or electromagnetic detectors.

In the example of a rear engagement pin, as illustrated within FIG. 1 and FIG. 2, alternative detection solutions may involve providing a switch or other detector on the rear locking member positioned to detect the presence of the rear engagement pin when correctly clamped by the locking member. However as the locking member or attachment pin wears through use, the position of the rear locking member and pin when clamped may vary by an extent that causes the switch/detector not to detect the rear pin even though it is securely clamped. In any event, it is beneficial to detect that the pin is in the correct position on the bottom surface 60, 160 before operating the locking member to prevent the risk of the locking device missing the pin when the locking member is closed. Therefore the preferred solution is to detect that the pin is against the bottom surface 60, 160 before clamping, and preferably also to indicate that the pin is clamped correctly against the bottom surface 60, 160 by the locking member during use.

Alternatively still, one or more pin detectors, for example electromechanical switches, opto-electronic switches and/or electro-magnetic switches, may be provided at the recess 122 and configured to detect the presence of the pin 27, 127 against the surface 60, 160 for any relevant pin spacing(s). However in typical embodiments where it is necessary to accommodate a range of pin spacings, a plurality of such detectors would typically be required, which may be relatively difficult to implement and maintain.

Figure 6:
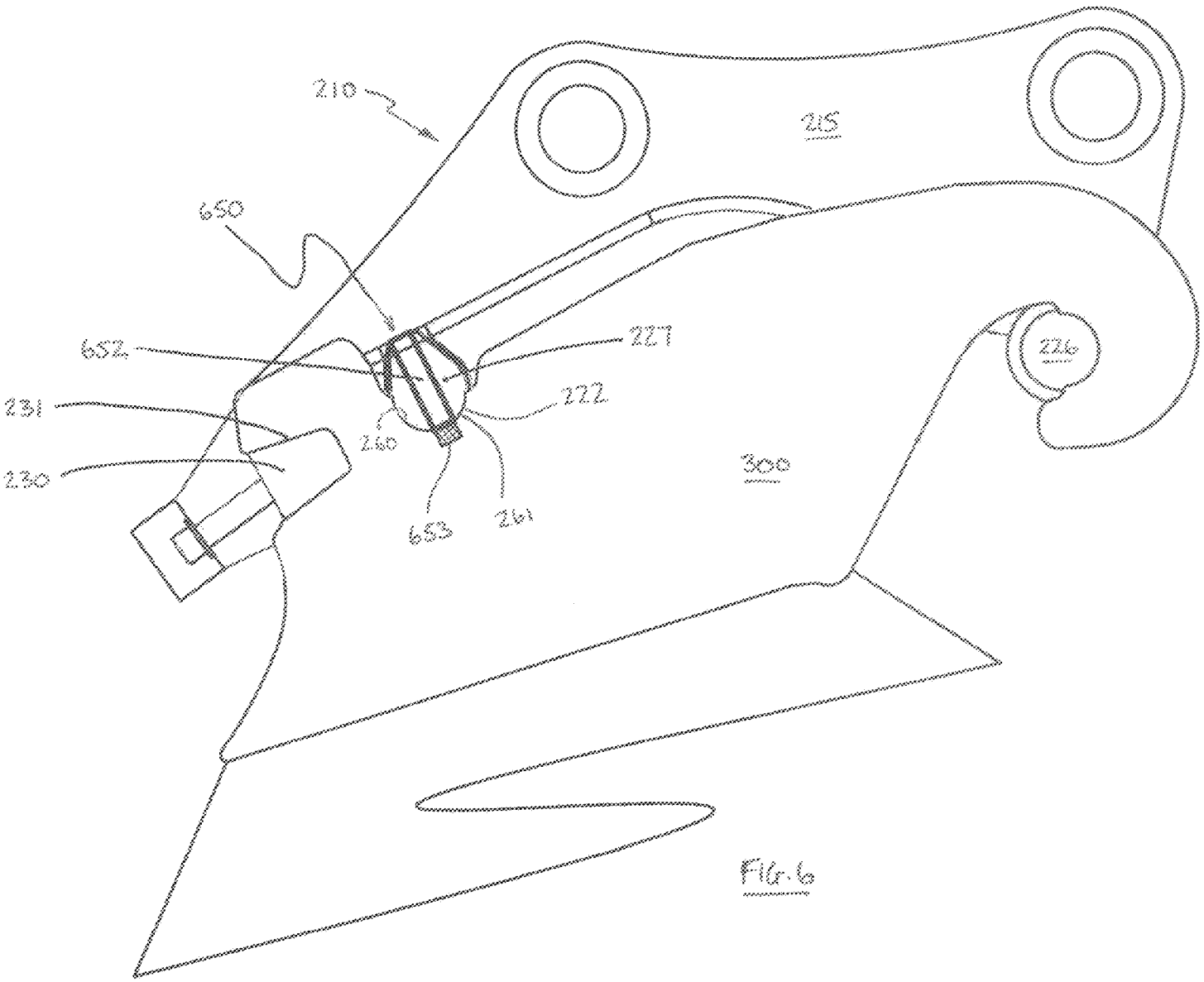
FIG. 6 is an interior side view of part of a third coupler embodying one aspect of the invention, the coupler being of the type shown in FIG. 3 and including a detection system embodying another aspect of the invention.

FIG. 6 shows a pin detection system 650 embodying one aspect of the invention included in the dedicated coupler 210. The pin detection system 650 comprises a sensor 652 with detection zone 653. The system 650 may be similar to the detection system 450 and so a similar description applies, as would be apparent to a skilled person, unless otherwise indicated. Accordingly, when the coupling protrusion 227 (which may be referred to as a pin) is correctly positioned in the recess 222 to allow it to be engaged correctly by the locking member 230, the pin 227 (i.e. at least part of it) is in the detection zone 653 and is detected by sensor 652, the detection being indicated by the output of the sensor 652, which can therefore be used as an indication of the correct engagement of the attachment and coupler prior to the operation of the locking member 230.

When the pin 227 is correctly positioned in the recess 222, a recess-engaging surface 260 of the pin 227 engages a pin-receiving surface 261 of the recess 222 (which is usually a surface of the head 300). The recess-engaging surface 260 is usually comprises the free end, or tip, of the pin 227, or more generally at least part of the outer peripheral surface of the protrusion 227. The pin-receiving surface 261 typically comprises the bottom surface of the recess 222. The detection zone 653 extends outwardly from the surface 260 of the protrusion 227, e.g. from the tip of the protrusion 227. This may be achieved by appropriate positioning the sensor 652, e.g. by providing the sensor 652 on the protrusion 227 with its sensing end at or close to the end of the protrusion 227, e.g. at the tip of the protrusion 227. The length of the detection zone 653 (in particular the length that projects beyond the protrusion 227) is preferably relatively small, e.g. 5 mm to 30 mm, to reduce the likelihood of false detections.

When the pin 227 enters the recess 222, the pin-receiving surface 261 of the recess 222 must enter the detection area 653 before the surfaces 260, 261 engage. When the pin 227 and recess 222 engage, the surface 261 remains within the detection zone 653. Accordingly, when the pin 227 is correctly engaged with the recess 222 for the purposes of locking by the locking member 222 (i.e. prior to being engaged by the locking member and advantageously prior to operation of the locking member to the locking state), the sensor 652 detects the pin. Advantageously, while the locking member 230 is in the locking state, the sensor 652 continues to detect the pin-receiving surface 261 while it remains engaged with the surface 260, and its output signal may be indicative of this.

Therefore, when the pin 227 is correctly positioned in the recess 222 to allow the locking portion of the attachment head 300 to be engaged correctly by the locking member 230, the head 300 enters the detection area 653 and is detected by the sensor 652 which generates an output signal indicating the correct engagement of the attachment and coupler prior to the operation of the locking member.

In contrast with the embodiments of FIGS. 4 and 5, in the embodiment of FIG. 6 the detection zone is configured (i.e. shaped, dimensioned and/or directed, as applicable) to extend away from a surface of said first coupling formation that engages in use with the corresponding attachment coupling, for example away from the free end of the coupling projection 227.

In the preferred embodiment, the sensor 652 has a single continuous detection zone that detects the head 300 at, or close to, a position where the pin 227 engages with the recess 222. The detection zone 653 typically extends a short distance from the bottom surface of the recess 222 when engaged. In any case, the pin detection system 650 is capable of detecting the correct location of the pin 227 in the recess 222 to ensure attachments are located correctly without any direct mechanical contact between the sensor and the attachment and prior to the operation of the locking member 230. The detection system operation therefore advantageously does not involve contact between any part of the attachment head and the coupler.

Advantageously, the sensor 652 is provided at a location where it is protected from impacts, e.g. positioned on the protrusion 227, preferably on an inner surface of the protrusion, and preferably such that it does not project beyond the free end of the protrusion 227.

In the example of the dedicated type coupler incorrect engagement may or may not be detected by a sensor mounted within the rear locking member itself and in any case could only be detected after the initiation of the rear locking member. So the detection system 650 has similar advantages as the systems 450, 550.

Couplers are manufactured in a variety of different shapes and sizes. Typically, therefore the sensor 452, 552, 652 will need to be able to be programmed to produce a detection zone that matches the coupler to which it is fitted. Advantageously, the sensor is configured to be able to ignore objects other than the coupling formation that it is intended to detect when correctly positioned, e.g. programmed not to detect objects outside of the aperture 22, 122, to prevent foreign objects from inadvertently operating the system.

The detection means, in particular the sensor 452, 552, 652 in preferred embodiments, is preferably co-operable with one or more indication device (not shown), for example one or more audio and/or visual indicator that may be located in the operator's cab or other convenient location where it may be seen or heard by the operator, to cause the indication device(s) to be activated to indicate whether or not the sensor 452, 552, 662 has detected a pin or other coupling formation in the detection zone, i.e. whether or not the rear coupling formations have engaged correctly. Once the operator determines that the rear coupling formations have engaged correctly position, he can operate the locking member to hold it in place. It is preferred that the detection means and the indication device(s) together provide an indication that the pin/coupling formation is in the correct position so long as it remains in the correct position. The output signal of the sensor 452, 552, 652 may be connected directly to the indication device(s) or to a controller (not shown), e.g. comprising an electrical control circuit, which activates the indication device(s).

As indicated above, the signal generated by the sensor 452, 552, 652 may be caused to activate a lamp and/or an audible signal for the operator. However, the signal could alternatively, or additionally, be utilised by an electronic and/or computer control system (not shown) that may be configured to, for example, ensure correct use of the coupler (e.g. by preventing operation of one or more aspects of the coupler (e.g. closing the locking member 30, 130, 230 unless the pin 27, 127, 227 is determined to be in the correct position), and which may incorporate a self-testing function for testing of the operation of the pin detection system and may further limit the use or the available power e.g. by the limitation of the engine speed, of the excavator or other machine unless the attachment is correctly engaged and detected correctly by the sensor.

More generally, the signal from the sensor may be integrated into a coupler control circuit, the control circuit being responsive to the sensor signal to prevent the coupler closing until the relevant coupling engagement is correct, and/or may be integrated into the excavator's, or other machine's, control system to take one or more disabling action, such as reducing machine power, until the engagement is detected as being correct.

Optionally therefore, the detection system 452, 552, 652 may be integrated with a controller (not shown) of the coupler 10, 110, 210, the controller being responsive to said output signal, or a derivative thereof, to prevent the locking member from adopting said locked state unless said output signal, or derivative, indicates that the respective attachment coupling formation is detected in said detection zone.

Optionally, the detection system 452, 552, 652 may be integrated with a controller (not shown) of said excavator or other apparatus, the controller being responsive to said output signal, or a derivative thereof, to prevent or restrict operation of said excavator or other apparatus unless said output signal, or derivative, indicates that the respective attachment coupling formation is detected in said detection zone. For example the controller may be configured to fully or partly disable one or more power supply of the excavator or apparatus, e.g. disabling the engine and/or hydraulic system.

In alternative embodiments (not illustrated), the, or each, sensor may be of a type that generates a detection zone by generating an electromagnetic sensing field, or a magnetic sensing field, or an optical sensing field. For example, the detection system may comprise one or more electric field sensor, one or more radio frequency (RF) sensor, one or more magnetic sensor, and/or one or more optical, e.g. infra-red or laser, sensor.

In typical embodiments there is only one sensor, although more than one could be provided. Optionally, any combination of two or more sensor types may be provided, i.e. one or more sensor of each of any two or more sensor types.

In preferred embodiments, the sensor 452, 552, 652 comprises a single transceiver type sensor component that generates the detection zone 453, 553, 653 and detects the presence of an object in the detection zone. Alternatively, the sensor may comprise two or more sensor components, for example spaced apart sensor components between which the detection zone is defined in use. In such cases, there may be provided one or more transmitter component (which generates the sensing field/waves as applicable that create the detection zone) spaced apart from and aligned with one or more receiver component (which detects the presence of a target object in the detection zone). Alternatively, there may be provided one or more reflector component spaced apart from and aligned with one or more transceiver sensor component, or spaced apart from and aligned with one or more transmitter component and one or more receiver component.

The invention is not limited to the embodiments described herein which may be modified or varied without departing from the scope of the invention.

The invention claimed is:

1. A coupler for coupling an attachment to an apparatus, the coupler comprising:

a body having a first and second spaced-apart coupling formations for coupling with a respective corresponding coupling formation of the attachment;

a locking member movable into and out of a locking state to retain the respective attachment coupling formation in engagement with the first coupling formation when in the locking state;

actuating means for actuating the locking member into and out of the locking state; and a detection system configured to detect if the respective attachment coupling formation is in a desired position with respect to the first coupling formation, the detection system comprising at least one directional ultrasonic sensor configured to generate an elongate beam shaped ultrasonic detection zone, wherein said at least one ultrasonic sensor is configured so that said elongate beam shaped ultrasonic detection zone extends across a surface of the first coupling formation that engages in use with the respective attachment formation when the respective formations are correctly engaged in use so that, when there is correct engagement, the attachment coupling formation is detected in the detection zone, and wherein said detection system is configured to generate an output signal that is indicative of whether the respective attachment coupling formation is detected in the detection zone.

2. The coupler of claim 1, wherein the detection zone extends across a pin-receiving surface of the coupler and the pin-receiving surface is located in a pin-receiving recess of the coupler.

3. The coupler of claim 1, wherein the at least one ultrasonic sensor is configurable to adjust one or more characteristics of the detection zone.

4. The coupler of claim 1, wherein the at least one ultrasonic sensor is provided on the body of the coupler adjacent the first coupling formation.

5. The coupler of claim 1, wherein the detection system includes indication means, responsive to one of the output signal and a derivative thereof, for indicating to an operator that the respective attachment coupling formation is detected in the desired position, and the indication means comprises at least one of the group consisting of one or more audio indicators and one or more visual indicators.

6. The coupler of claim 1, wherein the detection system is integrated with a controller of the coupler, the controller being responsive to one of the output signal and a derivative thereof, to prevent the locking member from adopting the locked state unless the one of the output signal and derivative indicates that the respective attachment coupling formation is detected in the detection zone.

7. The coupler of claim 1, wherein the detection system is integrated with a controller, the controller being responsive to one of the output signal and a derivative thereof, to prevent operation of the apparatus unless the one of the output signal and derivative indicates that the respective attachment coupling formation is detected in the detection zone.

8. The coupler of claim 1, having a pin-receiving recess with a pin-engaging surface, the detection system being configured to detect the presence of the attachment coupling formation against the engaging surface and wherein an indicating means is configured to indicate to an operator that the attachment coupling formation is detected against the engaging surface.

9. The coupler of claim 1, wherein the surface has a width that accommodates attachments having different coupling formation spacings, and wherein the pin detection system is configured to detect the presence of the attachment coupling formation in any one of multiple locations in engagement with the surface.

10. The coupler of claim 1, wherein the detection system detects, in use, the presence of the attachment coupling formation in the desired position for locking prior to operation of the locking member to the locking state, and wherein, an indicating means indicates to an operator, in use, that the attachment coupling formation is detected in the desired position prior to operation of the locking member to the locking state.

11. The coupler of claim 1, wherein said at least one ultrasonic sensor is configurable to adjust a length of said beam shaped detection zone.

12. A coupler for coupling an attachment to an apparatus, the coupler comprising:

a body having a first and second spaced-apart coupling formations for coupling with a respective corresponding coupling formation of the attachment;

a locking member movable into and out of a locking state to retain the respective attachment coupling formation in engagement with the first coupling formation when in the locking state;

actuating means for actuating the locking member into and out of the locking state; and a detection system configured to detect if the respective attachment coupling formation is in a desired position with respect to the first coupling formation, the detection system comprising at least one directional ultrasonic sensor configured to generate an elongate beam shaped ultrasonic detection zone, said at least one ultrasonic sensor is configurable to adjust a length of said beam shaped detection zone.

* * * * *